US010726985B2

(12) United States Patent
Carlino

(10) Patent No.: US 10,726,985 B2
(45) Date of Patent: Jul. 28, 2020

(54) MULTI-STAGE ACTUATOR ASSEMBLY

(71) Applicant: Schaeffler Technologies AG & Co. KG, Herzogenaurach (DE)

(72) Inventor: Ryan Carlino, Charlotte, NC (US)

(73) Assignee: SCHAEFFLER TECHNOLOGIES AG & CO. KG, Herzogenaurach (DE)

( * ) Notice: Subject to any disclaimer, the term of this patent is extended or adjusted under 35 U.S.C. 154(b) by 308 days.

(21) Appl. No.: 15/928,161

(22) Filed: Mar. 22, 2018

(65) Prior Publication Data

US 2019/0295757 A1 Sep. 26, 2019

(51) Int. Cl.
*H01F 7/00* (2006.01)
*H01F 7/08* (2006.01)
*H01F 7/16* (2006.01)

(52) U.S. Cl.
CPC ..... *H01F 7/081* (2013.01); *H01F 7/16* (2013.01)

(58) Field of Classification Search
CPC ..... H01F 7/081; H01F 7/16
USPC ..... 335/278
See application file for complete search history.

(56) References Cited

U.S. PATENT DOCUMENTS 1,339,922 A * 5/1920 Deutsch ..... H01H 71/68 335/236
1,354,708 A * 10/1920 Whittingham ..... H01H 71/68 318/447
1,369,934 A * 3/1921 Onstad ..... B44B 7/00 101/27
2,005,195 A * 6/1935 McCabe ..... H01H 29/00 318/285
2,157,844 A * 5/1939 Armstrong ..... H01F 7/1205 335/245
2,654,009 A * 9/1953 Stuellein ..... H01H 71/443 335/29
2,663,774 A * 12/1953 MacNeill ..... H01H 71/443 335/40
2,959,962 A * 11/1960 Epstein ..... G01L 9/007 73/728
3,098,912 A * 7/1963 Sprague ..... H01H 71/1027 335/9
3,234,344 A * 2/1966 Heilman ..... H01H 71/2463 335/62
3,268,043 A * 8/1966 Murdoch ..... F16D 27/112 192/84.961
3,272,934 A * 9/1966 Schwartz ..... H01H 71/1045 200/50.4
3,307,125 A * 2/1967 Schwarzkopf ..... H02K 33/10 335/95

(Continued)

*Primary Examiner* — Shawki S Ismail
*Assistant Examiner* — Lisa N Homza
(74) *Attorney, Agent, or Firm* — Volpe and Koenig, P.C.

(57) ABSTRACT

An actuator assembly is disclosed. The actuator assembly includes a driven component, a coil housing including a first coil and a second coil, and an armature housing including a first armature and a second armature. The first armature is axially fixed to the armature housing, and the second armature is slidably received within the armature housing and axially fixed to the driven component. In a first energized state, the first coil is energized, and the driven component is driven a first predetermined distance towards the coil housing. In a second energized state, the first coil and the second coil are energized, and the driven component is driven a second predetermined distance towards the coil housing.

15 Claims, 3 Drawing Sheets

(56) References Cited

U.S. PATENT DOCUMENTS 3,344,372 A * 9/1967 Heilman ..... H01H 71/44 335/28
3,363,571 A * 1/1968 Reynolds ..... F04B 43/02 222/642
3,517,357 A * 6/1970 Bakes ..... H01H 71/30 335/63
3,566,320 A * 2/1971 Bakes ..... H01H 71/345 335/174
3,773,992 A * 11/1973 Mune ..... H01H 9/342 218/149
3,788,597 A * 1/1974 Ichioka ..... F16K 31/0668 251/129.08
3,791,408 A * 2/1974 Saitou ..... F16K 17/04 137/529
4,267,539 A * 5/1981 Guinan ..... H01H 71/7463 335/176
4,316,167 A * 2/1982 Koehler ..... H01H 51/2209 335/229
4,515,343 A * 5/1985 Pischinger ..... F01L 1/16 123/90.11
4,540,965 A * 9/1985 Hattori ..... H01H 3/503 335/259
4,683,453 A * 7/1987 Vollmer ..... H01F 7/1607 335/255
5,207,410 A * 5/1993 Wakeman ..... F02M 51/005 251/129.15
5,389,910 A * 2/1995 Abel ..... H01F 7/1615 335/237
5,845,672 A * 12/1998 Reuter ..... B60T 8/3675 137/315.03
6,044,813 A * 4/2000 Bulgatz ..... F01L 9/04 123/90.11
6,049,264 A * 4/2000 Sailer ..... F01L 9/04 335/220
6,084,492 A * 7/2000 Cereda ..... H01F 7/081 335/220
6,092,784 A * 7/2000 Kalfsbeck ..... H01F 7/081 137/625.65
6,125,803 A * 10/2000 Hattori ..... F01L 9/04 123/90.11
6,155,503 A * 12/2000 Benson ..... F02M 51/06 239/585.1
6,157,277 A * 12/2000 Bulgatz ..... F01L 9/04 251/129.15
6,373,361 B1 * 4/2002 Umemoto ..... F01L 9/04 251/129.15
6,373,363 B1 * 4/2002 Spakowski ..... F02M 51/0614 251/129.15
6,414,406 B1 * 7/2002 Ikoma ..... H01F 7/081 310/14
6,420,949 B1 * 7/2002 Umemoto ..... F01L 9/04 335/251
6,677,844 B1 * 1/2004 Gorospe ..... H01F 7/16 335/220
8,136,790 B2 * 3/2012 Hoppe ..... F01L 1/34 251/129.15
8,350,652 B2 * 1/2013 Hoppe ..... F01L 1/3442 310/12.31
9,502,167 B1 * 11/2016 Gieras ..... H01F 7/081
2001/0003277 A1 * 6/2001 Oyama ..... F01L 1/462 123/90.11
2001/0040018 A1 * 11/2001 Bulgatz ..... F01L 9/04 164/109
2002/0057154 A1 * 5/2002 Keck ..... F01L 9/04 335/256
2002/0066176 A1 * 6/2002 Paasch ..... F01L 9/04 29/602.1
2004/0025949 A1 * 2/2004 Wygnaski ..... F16K 31/0682 137/624.18
2004/0257185 A1 * 12/2004 Telep ..... H01F 7/13 335/220
2005/0189021 A1 * 9/2005 Wygnanski ..... F16K 31/0682 137/625.44
2006/0049901 A1 * 3/2006 Bottcher ..... H01F 7/066 335/229
2007/0062591 A1 * 3/2007 Armour ..... F16K 31/0675 137/625.65
2007/0171009 A1 * 7/2007 Bouchard ..... G10B 3/06 335/14
2007/0171016 A1 * 7/2007 Bonjean ..... H01F 7/1615 335/234
2008/0129432 A1 * 6/2008 Buezis ..... F16K 31/0682 335/265
2009/0001302 A1 * 1/2009 Murayama ..... F16K 31/0675 251/65
2010/0186719 A1 * 7/2010 Venkataraghavan ..... F02M 47/027 123/472
2010/0294221 A1 * 11/2010 Talon ..... H01F 7/081 123/90.11
2011/0253918 A1 * 10/2011 Rampen ..... F04B 7/0076 251/65
2011/0285484 A1 * 11/2011 Hoppe ..... H01F 7/081 335/229
2012/0153199 A1 * 6/2012 Nguyen ..... F16K 27/029 251/129.15
2012/0268225 A1 * 10/2012 Mahajan ..... H01F 7/13 335/261
2015/0318135 A1 * 11/2015 Schuster ..... H01H 50/16 335/43
2015/0340144 A1 * 11/2015 Schmitz ..... H01F 5/02 335/262
2017/0175919 A1 * 6/2017 Robertson ..... H01F 7/1615
2017/0284556 A1 * 10/2017 Omekanda ..... H01F 7/081
2018/0233260 A1 * 8/2018 Franz ..... B60K 5/1283
2019/0121120 A1 * 4/2019 Schiepp ..... F16K 31/0675
2019/0148045 A1 * 5/2019 Tsuzuki ..... H01F 27/28 335/209

* cited by examiner

MULTI-STAGE ACTUATOR ASSEMBLY

FIELD OF INVENTION

The present invention relates to an actuator assembly, and more particularly relates to a multi-stage actuator assembly.

BACKGROUND

Actuator assemblies with electromagnetic arrangements are well known. Actuator assemblies typically include a coil and an armature. These known actuators energize the coil to attract the associated armature. The armature or the coil can be attached to any component adapted to be driven. The attractive force generated between the coil and the armature decreases logarithmically as the gap between the two increases. Larger gaps can be closed by a coil/armature combination by increasing the size of the coil. However, it is typically important to also reduce the weight and dimensions of any actuator assembly in order to comply with efficiency and size demands of the associated assembly.

Accordingly, there is a need to provide a lightweight, compact, and reliable actuator assembly.

SUMMARY

A multi-stage actuator assembly is disclosed herein. In one embodiment, the actuator assembly includes a driven component, a coil housing, and an armature housing. The coil housing includes a first coil and a second coil, and the first coil and the second coil are independently energizable. The armature housing includes a first armature and a second armature. The first armature is axially fixed to the armature housing, and the second armature is slidably received within the armature housing and axially fixed to the driven component. In a first energized state, the first coil is energized, and the driven component is driven a first predetermined distance from an initial position towards the coil housing. In a second energized state, both the first coil and the second coil are energized, and the driven component is driven a second predetermined distance from the initial position towards the coil housing.

In another embodiment, an actuator assembly is provided. The actuator assembly includes a driven component, and a coil housing including a first coil and a second coil. The first coil and the second coil being independently energizable. An armature housing includes a first armature axially fixed within a first seat and a second armature slidingly supported against a second seat. The first seat and the second seat are axially offset, and the second armature is slidably received within the second seat and is axially fixed to the driven component. In a first energized state, the first coil is energized, and the driven component is driven a first predetermined distance from an initial position towards the coil housing until the first armature abuts the first coil. In a second energized state, both the first coil and the second coil are energized, and the driven component is driven a second predetermined distance from the initial position towards the coil housing until the first armature abuts the first coil and the second armature abuts the second coil.

In another embodiment, a method of driving a component is provided. The method includes providing an actuator assembly. The actuator assembly includes a driven component; a coil housing including a first coil and a second coil, the first coil and the second coil being independently energizable; and an armature housing including a first armature and a second armature. The first armature is axially fixed to the armature housing, and the second armature is slidably received within the armature housing and axially fixed to the driven component. The method includes energizing the first coil such that first armature is driven towards the coil housing, and the driven component is driven a first predetermined distance towards the coil housing. The method includes energizing the first coil and the second coil such that the first armature and the second armature are driven towards the coil housing, and the driven component is driven a second predetermined distance towards the coil housing.

BRIEF DESCRIPTION OF THE DRAWINGS

The foregoing Summary and the following detailed description will be better understood when read in conjunction with the appended drawings, which illustrate a preferred embodiment of the invention. In the drawings.

DETAILED DESCRIPTION OF THE PREFERRED EMBODIMENTS

Figure 1A:
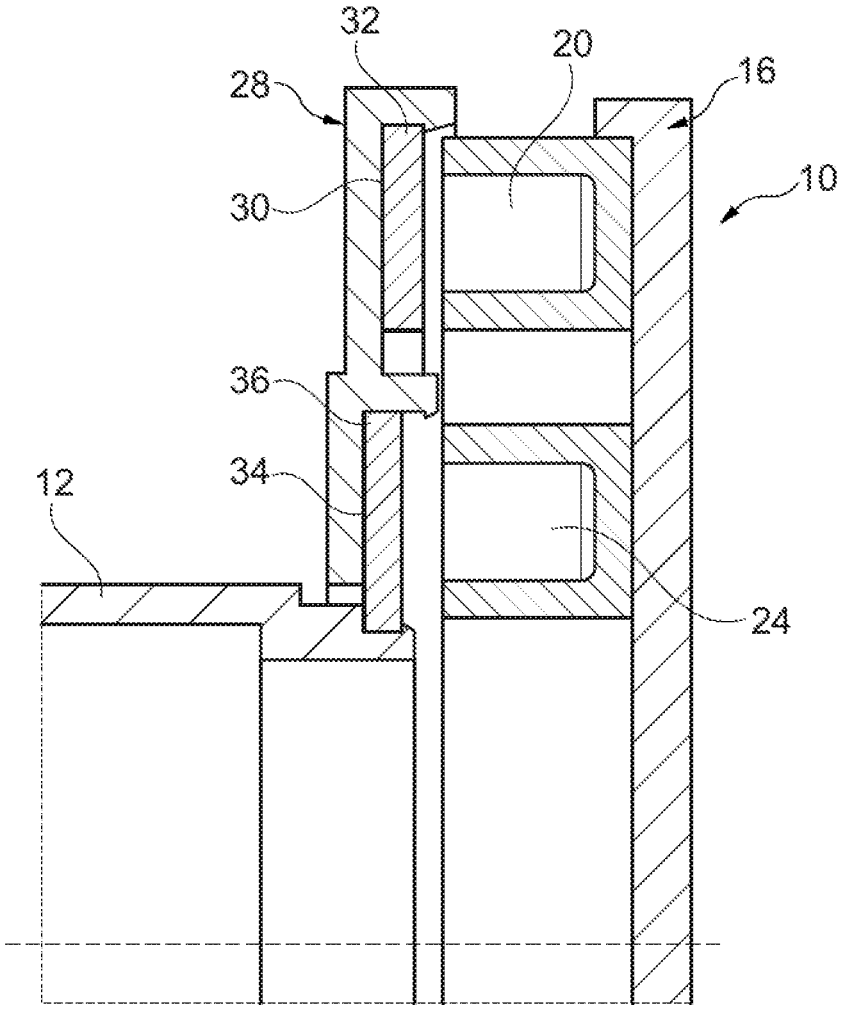
FIG. 1A is a cross section view of an actuator assembly in a de-energized state according to one embodiment.

Certain terminology is used in the following description for convenience only and is not limiting. The words "front," "rear," "upper" and "lower" designate directions in the drawings to which reference is made. The words "inwardly" and "outwardly" refer to directions toward and away from the parts referenced in the drawings. "Axially" refers to a direction along the axis of a shaft. A reference to a list of items that are cited as "at least one of a, b, or c" (where a, b, and c represent the items being listed) means any single one of the items a, b, or c, or combinations thereof. The terminology includes the words specifically noted above, derivatives thereof and words of similar import.

Figure 1B:
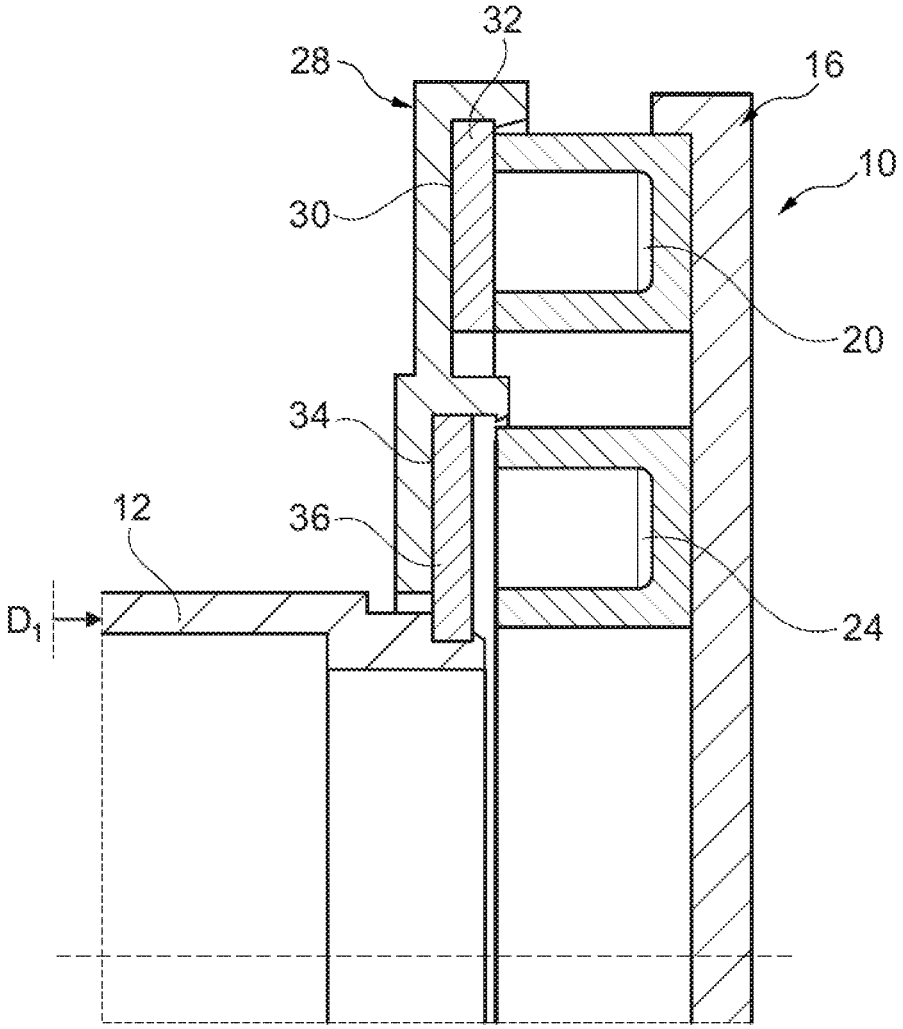
FIG. 1B is a cross section view of the actuator assembly of FIG. 1A in a first energized state.
Figure 1C:
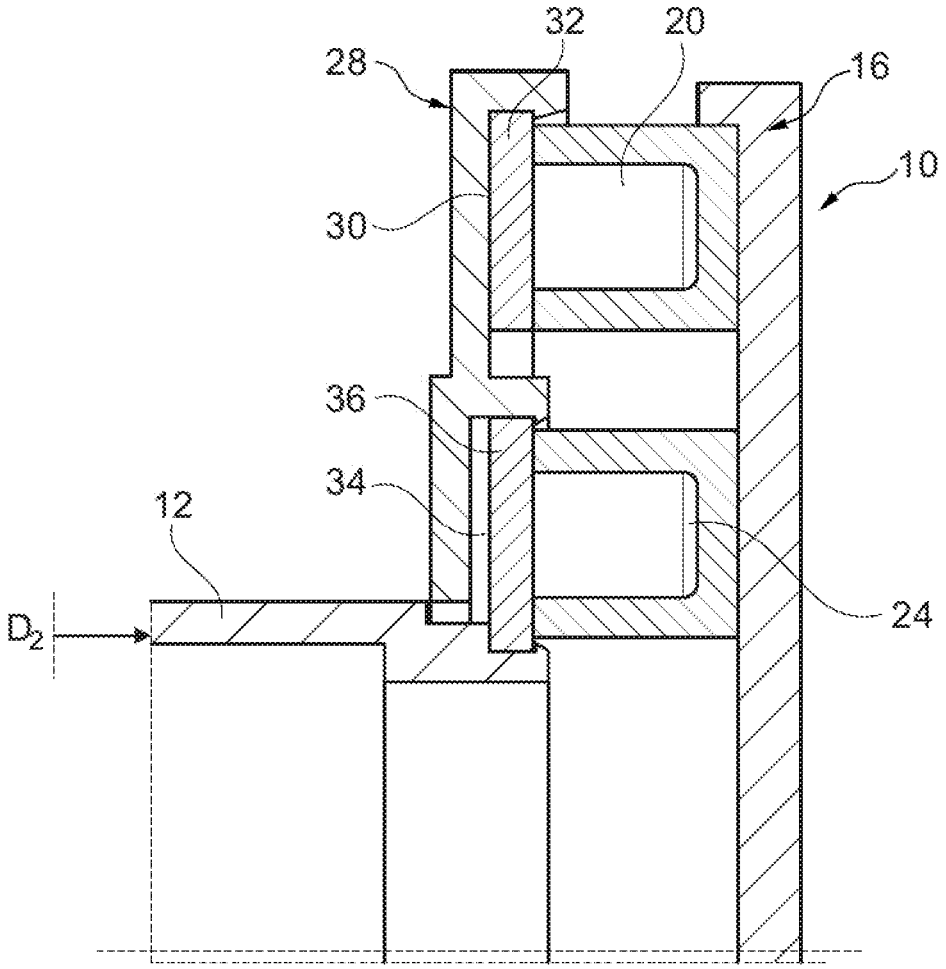
FIG. 1C is a cross section view of the actuator assembly of FIGS. 1A and 1B in a second energized state.

Referring to FIGS. 1A-1C, an actuator assembly 10 is shown in varying energized states. FIG. 1A illustrates the actuator assembly 10 in a de-energized state. The actuator assembly 10 includes a driven component 12. The driven component 12 can generally be any component that is required to be axially moved. In one embodiment, the driven component 12 is a cage. One of ordinary skill in the art would understand that the driven component 12 can be any other component.

A coil housing 16 includes a first coil 20 and a second coil 24. In one embodiment, the first coil 20 and the second coil 24 are identical, i.e. the coils have the same electromagnetic characteristics, capacity, strength, etc. In another embodiment, the first coil 20 and the second coil 24 have varying characteristics. One of ordinary skill in the art would understand that more than two coils can be provided.

In one embodiment, the first coil 20 and the second coil 24 are independently energizable. One of ordinary skill in the art would understand from the present disclosure that an associated circuit, controller, driver, or other electronic component can provide varying signals to the coils 20, 24 to provide varying energized states. In one embodiment, the first coil 20 and the second coil 24 are associated with a common circuit, controller, or driver. In another embodiment, the first coil 20 and the second coil 24 are each associated with separate circuits, controllers or drivers.

An armature housing 28 includes a first armature 32 and a second armature 36. The first armature 32 is axially fixed to the armature housing 28, and the second armature 36 is slidably received within the armature housing 28 and is axially fixed to the driven component 12. The first armature 32 is axially fixed to the armature housing 28 such that any axial movement of the first armature 32 causes the armature housing 28 to move the same axial distance of the first armature 32. The first armature 32 can be fixed to the armature housing 28 according to any known connection arrangement, and the second armature 36 can also be fixed to the driven component 12 according to any known connection arrangement.

As shown in FIG. 1A, in a de-energized state, the first armature 32 and the second armature 36 at least partially overlap in a radially extending plane. This arrangement provides an axially compact configuration.

As shown in the drawings, the armature housing 28 is arranged radially outward from the driven component 12. One of ordinary skill in the art would recognize that the relative positioning of the armature housing 28 and the driven component 12 can be modified depending on the specific requirements for an assembly.

In one embodiment, the armature housing 28 defines a first seat 30 that retains the first armature 32, and the armature housing 28 defines a second seat 34 configured to receive the second armature 36 depending on an energization state of the second coil 24. In one embodiment, the first seat 30 and the second seat 34 are axially offset from each other. In one embodiment, the second seat 34 has an axial depth of 1.3 mm-1.7 mm.

As shown in FIG. 1B, in a first energized state, the first coil 20 is energized, and the driven component 12 is driven a first predetermined distance ($D_1$) towards the coil housing 16. In one embodiment, the first predetermined distance is 1.3 mm-1.7 mm. In one embodiment, the first predetermined distance is 1.5 mm. As shown in the drawings, the first predetermined distance ($D_1$) is shown with reference to an initial starting position of the driven component 12.

As shown in FIG. 1C, in a second energized state, both the first coil 20 and the second coil 24 are energized, and the driven component 12 is driven a second predetermined distance ($D_2$) towards the coil housing 16. In one embodiment, the second predetermined distance is 2.6 mm-3.4 mm. As shown in the drawings, the second predetermined distance ($D_2$) is illustrated with respect to the initial starting position of the driven component 12. In one embodiment, the second predetermined distance ($D_2$) is 180%-220% of the first predetermined distance ($D_1$).

The axial stroke of the driven component 12 is equally split between each pair of (a) the first coil 20 and the first armature 32, and (b) the second coil 24 and the second armature 36. Each of these pairs provides an axial stroke of 1.3 mm-1.7 mm. In one embodiment, each pair of coil and armature provides an axial stroke of 1.5 mm.

As shown in FIGS. 1B and 1C, the first armature 32 abuts the first coil 20 in the first energized state (FIG. 1B), and the first armature 32 abuts the first coil 20 and the second armature 36 abuts the second coil 24 in the second energized state (FIG. 1C).

One of ordinary skill in the art would understand that the general concept of providing a multi-stage electromagnetic actuator arrangement can be adapted to a variety of different sized gaps and applications. Although two pairs of coils and armatures are disclosed herein, any number of pairs can be provided to provide a greater axial stroke.

Having thus described the present invention in detail, it is to be appreciated and will be apparent to those skilled in the art that many physical changes, only a few of which are exemplified in the detailed description of the invention, could be made without altering the inventive concepts and principles embodied therein. It is also to be appreciated that numerous embodiments incorporating only part of the preferred embodiment are possible which do not alter, with respect to those parts, the inventive concepts and principles embodied therein. The present embodiment and optional configurations are therefore to be considered in all respects as exemplary and/or illustrative and not restrictive, the scope of the invention being indicated by the appended claims rather than by the foregoing description, and all alternate embodiments and changes to this embodiment which come within the meaning and range of equivalency of said claims are therefore to be embraced therein.

LOG OF REFERENCE NUMERALS

Actuator assembly 10
Driven component 12
Coil housing 16
First coil 20
Second coil 24
Armature housing 28
First seat 30
First armature 32
Second seat 34
Second armature 36

What is claimed is:

1. An actuator assembly comprising:

a driven component;

a coil housing including a first coil and a second coil, the first coil and the second coil being independently energizable; and an armature housing including a first armature and a second armature, the first armature axially fixed to the armature housing, and the second armature slidably received within the armature housing and axially fixed to the driven component, in a first energized state, the first coil is energized, and the driven component is driven a first predetermined distance from an initial position towards the coil housing, and in a second energized state, both the first coil and the second coil are energized, and the driven component is driven a second predetermined distance from the initial position towards the coil housing.

2. The actuator assembly of claim 1, wherein the first coil and the second coil have identical electromagnetic properties.

3. The actuator assembly of claim 1, wherein the first armature abuts the first coil in the first energized state, and the first armature abuts the first coil and the second armature abuts the second coil in the second energized state.

4. The actuator assembly of claim 1, wherein the armature housing is arranged radially outward from the driven component.

5. The actuator assembly of claim 1, wherein the armature housing defines a first seat that retains the first armature, and the armature housing defines a second seat configured to receive the second armature depending on an energization state of the second coil, wherein the first seat and the second seat are axially offset from each other.

6. The actuator assembly of claim 5, wherein the first seat is axially closer to the coil housing than the second seat.

7. The actuator assembly of claim 1, wherein the driven component is a cage.

8. An actuator assembly comprising:

a driven component;

a coil housing including a first coil and a second coil, the first coil and the second coil being independently energizable; and an armature housing including a first armature axially fixed within a first seat and a second armature slidingly supported against a second seat, the first seat and the second seat are axially offset, and the second armature is slidably received within the second seat and is axially fixed to the driven component, in a first energized state, the first coil is energized, and the driven component is driven a first predetermined distance from an initial position towards the coil housing until the first armature abuts the first coil, and in a second energized state, both the first coil and the second coil are energized, and the driven component is driven a second predetermined distance from the initial position towards the coil housing until the first armature abuts the first coil and the second armature abuts the second coil.

9. The actuator assembly of claim 8, wherein the first coil and the second coil have identical electromagnetic properties.

10. The actuator assembly of claim 8, wherein the armature housing is arranged radially outward from the driven component.

11. The actuator assembly of claim 8, wherein the first seat is axially closer to the coil housing than the second seat.

12. The actuator assembly of claim 8, wherein the second predetermined distance is 180%-220% of the first predetermined distance.

13. A method of driving a component, the method comprising:

providing an actuator assembly, the actuator assembly including:

a driven component;

a coil housing including a first coil and a second coil, the first coil and the second coil being independently energizable; and an armature housing including a first armature and a second armature, the first armature axially fixed to the armature housing, and the second armature slidably received within the armature housing and axially fixed to the driven component;

energizing the first coil such that first armature is driven towards the coil housing, and the driven component is driven a first predetermined distance towards the coil housing;

energizing the first coil and the second coil such that the first armature and the second armature are driven towards the coil housing, and the driven component is driven a second predetermined distance towards the coil housing.

14. The method of claim 13, wherein the armature housing defines a first seat that retains the first armature, and the armature housing defines a second seat configured to receive the second armature depending on an energization state of the second coil, wherein the first seat and the second seat are axially offset from each other.

15. The method of claim 14, wherein the first seat is axially closer to the coil housing than the second seat.

* * * * *